United States Patent [19]

Peet

[11] Patent Number: 4,887,431

[45] Date of Patent: Dec. 19, 1989

[54] SUPERHEATER OUTLET STEAM TEMPERATURE CONTROL

[75] Inventor: William J. Peet, Cambridge, Canada

[73] Assignee: The Babcock & Wilcox Company, New Orleans, La.

[21] Appl. No.: 333,482

[22] Filed: Apr. 5, 1989

[51] Int. Cl.[4] ..... F01K 13/02

[52] U.S. Cl. ..... 60/667; 60/653; 122/479 R

[58] Field of Search ..... 60/664, 665, 667, 653; 122/479 R

[56] References Cited

U.S. PATENT DOCUMENTS

| | | | |
|---|---|---|---|
| 3,169,374 | 2/1965 | Powell et al. | 60/653 X |
| 3,388,553 | 6/1968 | Anderson | 60/665 |
| 3,515,102 | 6/1970 | Hamilton, Jr. | 122/479 |
| 4,372,125 | 2/1983 | Dickenson | 60/653 X |
| 4,418,539 | 12/1983 | Wakamatsu | 60/667 X |
| 4,776,301 | 10/1988 | Dziubakowski | 122/479 R |

*Primary Examiner*—Allen M. Ostrager

*Attorney, Agent, or Firm*—Vytas R. Matas; Robert J. Edwards

[57] ABSTRACT

A method and apparatus for controlling superheater outlet temperature of a steam generator utilizes a feed-forward control signal to control a spray attemperator. The feed-forward control signal is developed as a difference between a selected flow rate for steam required by a turbine operated by the steam generator, and a measured flow rate of steam from a steam drum above the steam generator.

5 Claims, 2 Drawing Sheets

SUPERHEATER OUTLET STEAM TEMPERATURE CONTROL

FIELD AND BACKGROUND OF THE INVENTION

The present invention relates in general to steam generators, and in particular to a new and useful method and apparatus for controlling the output temperature of a superheater in a steam generator.

The normal method of controlling the superheater outlet temperature from a steam generator is by the use of a water attemperator located either at the superheater outlet or, more commonly, between the superheater stages, i.e. at the outlet of the primary superheater and before the inlet of the secondary superheater. This control system is normally designed to provide a feed-forward of the spray demand to an attemperator control valve, to improve control stability. The feed-forward control uses unit load and secondary superheater inlet steam temperature as an index. The limited variation of this steam temperature with load does not provide the feed-forward control of spray flow needed for a dynamic system, however.

U.S. Pat. No. 4,289,114 discloses a control system for a solar powered steam generator which controls its attemperator control valve using the mid-range of a signal which is formed as a function of the secondary superheater outlet temperature, process set points, and the attemperator temperature. The high and low range of the same signal is utilized to form a total feed-forward demand for the boiler feed water, as a function of total steam flow from the solar steam generator. The total steam flow is calculated from the sum of turbine steam flow as measured by the first stage pressure in the turbine and steam flow to storage, less steam flow from storage to the turbine.

U.S. Pat. No. 4,776,301 discloses a control system for generating a feed-forward signal which can be used to control a spray attemperator, the feed-forward signal including a computed value for heat absorption in the superheater required to maintain an enthalpy of the steam discharge from the superheater at a set point value. Known functional relationships exists between the enthalpy of steam, and its pressure and temperature.

U.S. Pat. No. 3,894,396 provides an overview of a typical steam generator operation including a furnace with economizer, primary and secondary superheaters and reheater, as it is used to generate steam to drive high, intermediate and low pressure turbines which in turn, drive a generator for generating electricity. This patent also discloses the use of separate control loops, each operating in parallel, including an auxiliary control for a spray type attemperator.

SUMMARY OF THE INVENTION

An object of the present invention is to provide a reliable feed-forward signal for spray water flow to the steam temperature control loop of a steam generator. The improved response of the inventive system provides steam temperature control with less overshoot or lag, particularly during load changes.

The invention is based on the following analysis of the operation of a steam generator:

Consider a drum type steam generator used in a Utility plant. The demand for the boiler is supplied from the turbine/generator MW requirement.

The turbine requirement is generally for a specific flow rate of steam at a particular enthalpy. The enthalpy must be at or below a maximum value for a satisfactory service life and preferably at a design value for optimum efficiency of the turbine cycle.

For a given thermal efficiency of the steam generator and a given entering feedwater temperature, the steam generator will provide an output to the turbine which will equal that required as shown below:

$$\text{Input Energy (i.e. fuel)} \times \text{Thermal Efficiency} = \text{Output Energy}$$

$$\text{Output Energy} = \text{Energy to Turbine} - \text{Energy Entering Steam Generator}$$

$$\text{Energy to Turbine} = \text{Flow Rate} \times \text{Enthalpy of Steam}$$

Thus, the total energy supplied by the steam generator will always equal that required at steady state conditions (provided that thermal efficiency and feedwater enthalpy remain constant).

Within the steam generator, however, the heating surfaces are divided into two general categories, namely:

Type (1) Surface which preheats and boils water to form steam.

Type (2) Surface which superheats the steam formed above.

In general, the economizer, furnace walls and convection pass enclosures are Type 1 surfaces, while the convection surface itself is Type 2. The separation between Type 1 and Type 2 surfaces occurs at the steam drum.

Thus, the production of steam from the drum can be different from the desired flow rate to the turbine due to changes in the portions of heat absorbed by the Type 1 and Type 2 surfaces. The total energy to the turbine, however, will remain equal to that required. Consequently, a steam production from the drum which is less than the flow rate required at the turbine will result in an enthalpy of the steam which is greater than required by the turbine. Also, a flow rate greater than required will be at a lower enthalpy than required as shown in the equations below:

$$\text{Turbine Requirement} = WxH_1$$

$$WxH_1 = W_s \times H^* \quad W_s > W \text{ Then } H^* < H_1$$
$$W_s < W \text{ Then } H^* > H_1$$

Where $W$ = flow rate demand $H_1$ = enthalpy demand $W_s$ = actual flow rate $H^*$ = actual enthalpy The purpose of the steam attemperator can now readily be seen to be to provide the necessary additional flow rate ($W-W_s$) so that $H^*=H_1$ (when $W_s>W$, attemperator flows cannot provide any useful purpose).

The invention described here measures the difference between the flow rate required by the turbine and the flow rate of steam from the steam drum to provide a feed-forward control to the spray attemperator. The feedback control of the spray attemperator is from a measurement of final steam temperature from the steam generator as currently employed in the industry.

Accordingly, another object of the present invention is to provide a method of controlling superheater outlet temperature in a steam generator having a superheater, a spray attemperator operatively connected to the superheater for receiving a feed-forward control for influencing the superheater outlet temperature, and a steam drum for discharging steam at a flow rate, comprising: selecting a flow rate of steam required for a turbine to be operated by steam from the steam generator; measuring the flow rate of steam from the steam drum; taking the difference between the selected flow rate and the measured flow rate; and using the difference as the feed-forward control for the spray attemperator.

Another object of the present invention is to provide an apparatus for controlling the superheater outlet temperature of a steam generator which utilizes means for selecting the flow rate of steam required by the turbine, means for measuring the flow rate of steam from the steam generator and means for obtaining the difference between the selected and measured flow rates for use as the feed-forward control of the spray attemperator.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
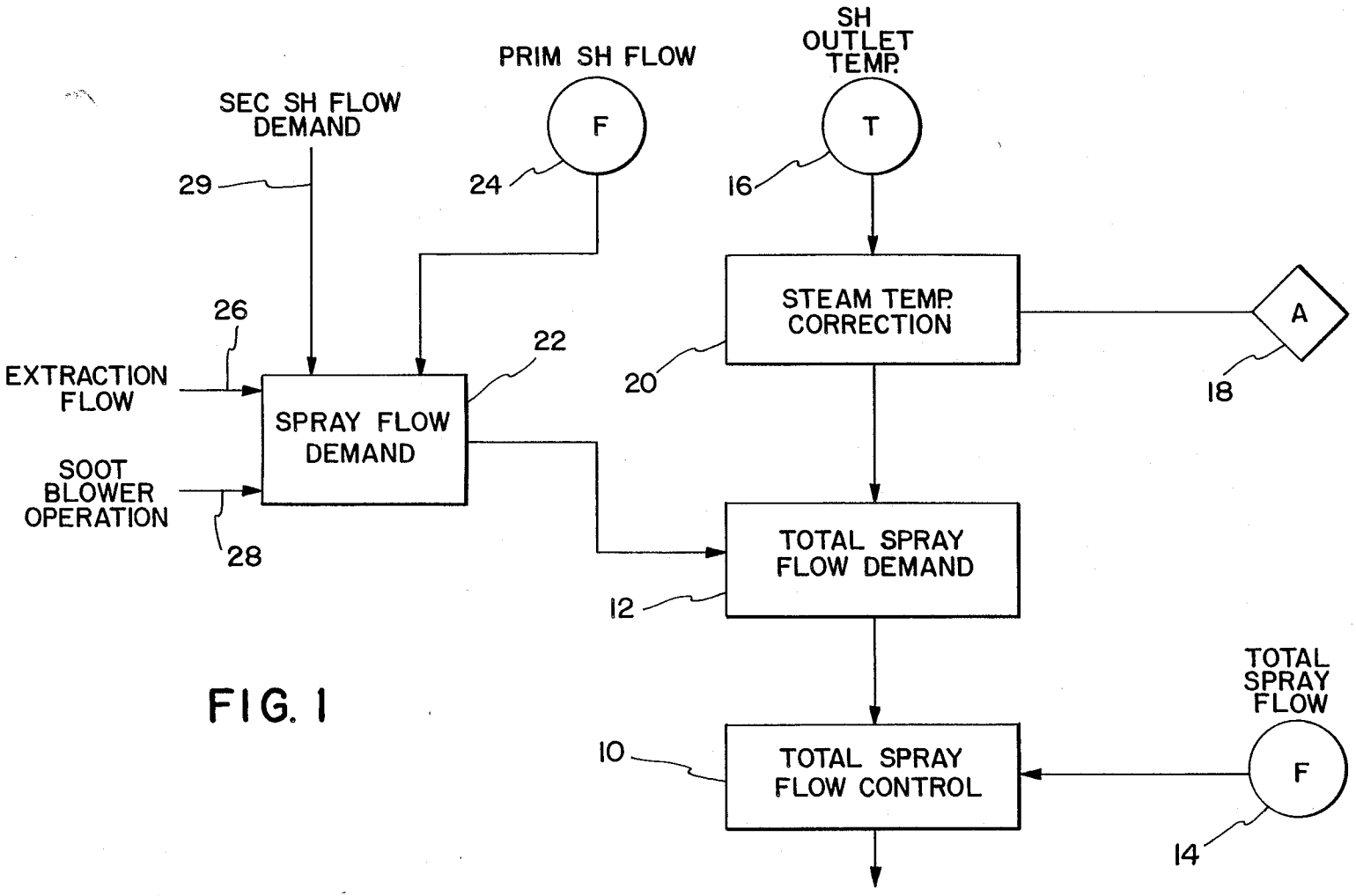
FIG. 1 is a block diagram showing a control scheme in accordance with one embodiment of the present invention.

Referring to FIG. 1 in particular, the invention embodied therein comprises a method and apparatus for controlling superheater outlet temperature in a steam generator having a superheater, a spray attemperator connected operatively to the superheater for reducing the temperature for superheated steam thereof, a steam drum operatively connected to the superheater, an economizer operatively connected to the steam drum and means for controlling the flow of water/steam through the steam generator for generating steam to drive a turbine at a required or demand level.

Figure 2:
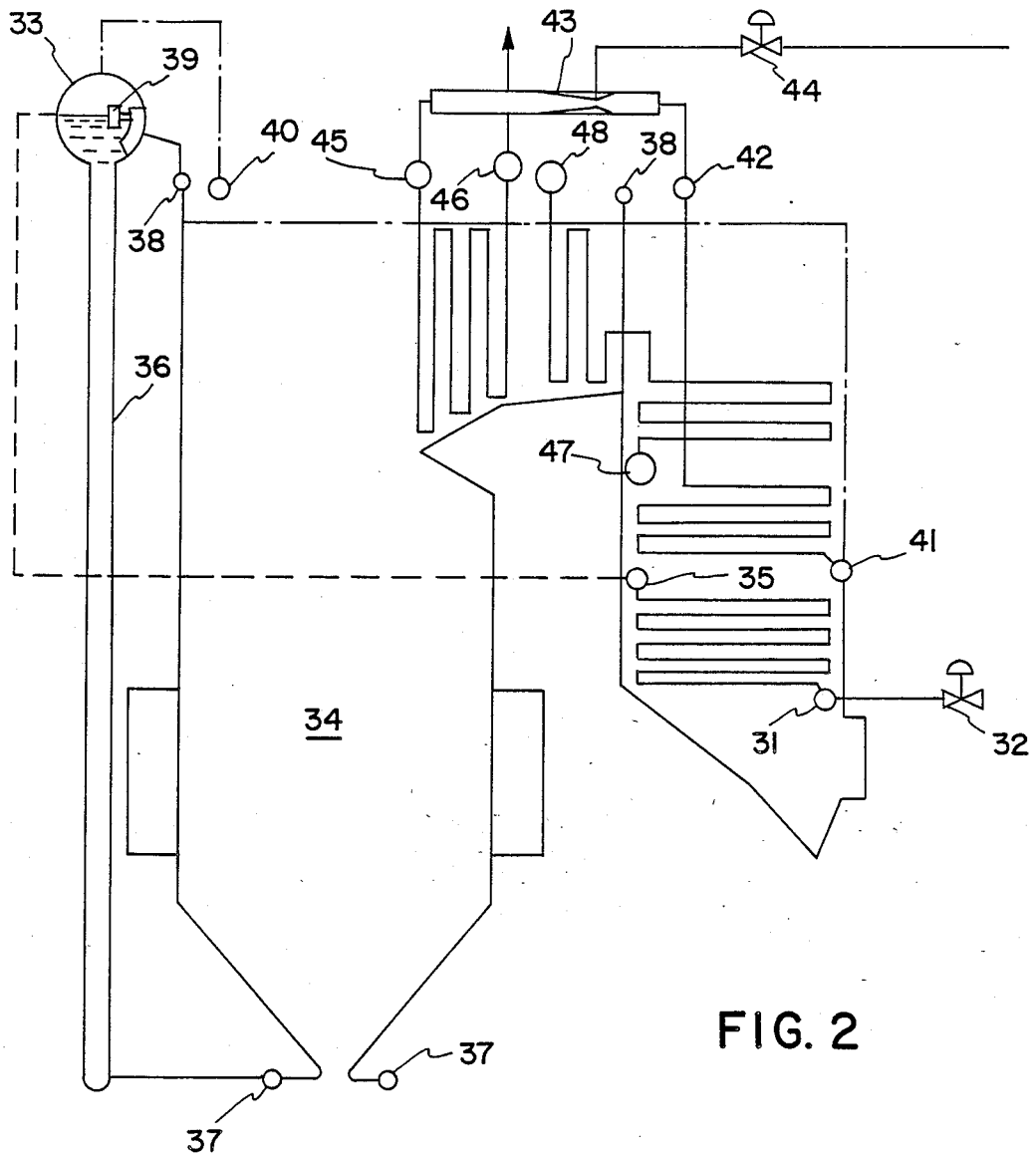
FIG. 2 is a schematic representation of a typical drum type steam generator used in conjunction with a turbine/generator for the production of electrical energy.

Referring now to FIG. 2, the invention can be used in a steam generator where the feedwater enters the steam generator at the economizer inlet 31 the flow rate of which is regulated by a feedwater control valve 32 according to the water level in a steam drum 33. The feedwater flows through the economizer tubes within the steam generator where the water is heated by the hot gases produced from the combustion of the fuel in a furnace 34. The water leaves the economizer at an outlet header 35 and passes by a conduit to the steam drum 33 and is added to the water within the steam drum. The water in the steam drum flows into downcomers 36 and thence to lower headers of the furnace walls 37.

The radiant heat from the combustion of fuel in the furnace 34 transforms part of the water flowing upwardly in the furnace walls to steam The steam/water mixture leaving the upper headers of the furnace walls 38 is carried by the conduits to the steam drum where steam separators 39 separate the steam from the water. The water is returned to the water space in the drum while the steam is removed from the steam drum by conduits to a saturated steam header 40. The steam from the saturated steam header 40 flows in the steam cooled enclosure tubes of the steam generator to the primary superheater inlet header 41 from which it enters the primary superheater tubes within the steam generator where the steam is heated by the flow of the hot gases produced from the combustion of the fuel.

The steam leaves the primary superheater at the primary superheater outlet header 42 and is carried by conduit to an attemperator 43. Within the attemperator 43 spray water is added to the steam, the evaporation of which reduces the temperature of the steam while increasing the total mass flow of steam. The flow of spray water is controlled by a valve 44 to achieve the steam temperature required by the turbine. The steam leaves the attemperator 43 and enters the secondary superheater inlet header 45 from which it enters the secondary superheater tubes for additional heating by the flow of hot gases over the tubes. The steam leaves the secondary superheater at the outlet header 46 and thence enters a conduit which connects the outlet of secondary superheater to the inlet of the steam turbine.

Although not part of the present invention, a reheater with inlet header 47 and outlet header 48 is also depicted for completeness of the diagram.

According to the invention, the superheater outlet temperature is controlled by setting the total spray flow control shown at 10 in FIG. 1, at the correct level, in the simplest possible manner. This is done in accordance with the present invention, by measuring the difference between the flow rate required by the turbine and the flow rate of steam from the steam drum to provide the feed-forward control.

There are several ways in which the measurement of the steam flow from the drum may be accomplished:

(1) Using a mass balance at the steam drum. This would involve measurement of feedwater flow to the drum, blowdown flow from the drum and the rate of change in the mass inventory within the circulating loop of the steam generator due to drum level, pressure and load changes.

(2) Using the pressure drop from the steam drum to the primary superheater outlet (suitably compensated for pressure and temperature) to provide a measurement of steam flow.

(3) Installing flow measurement devices in the saturated steam lines from the steam drum (with pressure compensation).

Any of the above techniques would provide a measurement of steam flow from the drum which can then be compared to the steam flow required by the turbine to produce a spray water demand. Adjustment of this spray demand 22 to account for auxiliary steam 26 or sootblower steam extraction 28 from the primary superheater outlet could be easily provided.

Some advantages of the present invention over current methods are summarized as follows:

(1) Since the feed forward spray flow demand is generated from a mass difference, a load versus spray flow function is not required.

(2) Variations in firing rate due to load changes are automatically included in the control since any deficiency in producing steam from the drum (due to over-firing) will provide the necessary increase in demand for spray flow.

(3) Similarly, under-firing for load reductions will provide the necessary reduction in feed-forward demand to the spray flow to compensate for this condition.

(4) Variations in excess air, gas recirculation, burner tilt applied to the furnace, as required for reheater steam temperature control will change the steam production from the drum and thus, the spray flow demand will be compensated automatically. Thus, reheater temperature controls will not adversely affect the superheater steam temperature control.

(5) Since mass flows are developed in the control loop, changes in pressure, such as variable pressure operation, do not affect the control stability.

(6) Variations in furnace slagging conditions which reduce steam production are automatically accounted for in the spray water controls.

(7) Upsets to the steam temperature control produced during soot blowing can be minimized by providing a signal to the spray demand when soot blowing to compensate for the steam flow take-off from the primary superheater outlet. Auxiliary steam from the primary superheater for heating, steam coil air heaters, etc., can also be accounted for within the demand development for spray flow, if necessary.

(8) Operation of the unit at lower feed water temperatures, such as T.H.O. would be automatically accounted for within the control system.

Any means by which the steam flow from the drum can be determined, could be utilized in the method of the invention The development of the secondary superheater steam flow demand 29 may be accomplished from the MW demand, feed water temperature and main steam temperature set point 18. This then would provide the target value for the sum of primary steam flow 24 (less extractions 26, plus spray water flow.

Returning to FIG. 1, the total spray flow control is developed from the total spray flow demand 12 and the actual spray flow as measured by a flow transmitter 14. The total spray flow demand 12 is developed from the superheater outlet temperature as measured by a temperature transmitter 16 and the manually set point 18 which are used to develop a steam temperature correction 20. The steam temperature correction is used in conjuction with a spray flow demand 22, to develop the total spray flow demand 12.

Spray flow demand 22, during normal operation of the steam generator, is developed using the measured superheater flow, measured by transmitter 24 and the set secondary superheater flow demand 29. The spray flow demand 22 may be modified for special purposed, for example for extracting steam at 26, or for sootblowing operations 28.

While a specific embodiment of the invention has been shown and described in detail to illustrate the application of the principles of the invention, it will be understood that the invention may be embodied otherwise without departing from such principles.

What is claimed is:

1. A method of controlling superheater outlet temperature in a steam generator having a superheater, a spray attemperator operatively connected to the superheater for receiving a feed-forward control for influencing the superheater outlet temperature, and a steam drum for discharging steam at a flow rate, comprising:

selecting a flow rate of steam required for a turbine to be operated by steam from the steam generator;

measuring the flow rate of steam from the steam drum;

taking the difference between the selected flow rate and the measured flow rate; and using the difference as the feed-forward control for the spray attemperator.

2. A method according to claim 1 including measuring the flow rate of steam from the steam drum by measuring the mass balance of steam at the steam drum.

3. A method according to claim 1 including measuring the flow rate of steam from the steam drum by measuring a pressure drop from the steam drum to the superheater outlet and taking the flow rate of steam from the steam drum as a function of the pressure drop.

4. A method according to claim 1 including at least one saturated steam line connected to the steam drum, the method including measuring the flow rate of steam from the steam drum at the saturated steam line.

5. An apparatus for controlling the superheater outlet temperature of a steam generator having a superheater, a spray attemperator controlled by a feed-forward control signal, operatively connected to the superheater, a steam drum operatively connected to the superheater for discharging steam at a flow rate for use by a turbine, and an economizer operatively connected to the steam drum, the apparatus comprising:

means for selecting a flow rate of steam required by the turbine;

means for measuring the flow rate of steam from the steam generator;

means for taking the difference between the selected and measured flow rates; and means for applying a signal corresponding to the difference to the spray attemperator as the feed-forward control signal therefor.

* * * * *